US011795750B2

(12) United States Patent
Kunkel

(10) Patent No.: US 11,795,750 B2
(45) Date of Patent: Oct. 24, 2023

(54) DUAL FUNCTION SNUBBER

(71) Applicant: Milgard Manufacturing LLC, Tacoma, WA (US)

(72) Inventor: Troy Kunkel, Olympia, WA (US)

(73) Assignee: MILGARD MANUFACTURING LLC, Tacoma, WA (US)

( * ) Notice: Subject to any disclaimer, the term of this patent is extended or adjusted under 35 U.S.C. 154(b) by 259 days.

(21) Appl. No.: 17/179,065

(22) Filed: Feb. 18, 2021

(65) Prior Publication Data

US 2022/0259911 A1 Aug. 18, 2022

(51) Int. Cl.
*E05F 7/00* (2006.01)

(52) U.S. Cl.
CPC ..... *E05F 7/005* (2013.01); *E05Y 2900/148* (2013.01)

(58) Field of Classification Search
CPC ..... E05F 7/005; E05Y 2900/148
See application file for complete search history.

(56) References Cited

U.S. PATENT DOCUMENTS 1,820,784 A * 8/1931 Devol ..... E05C 17/443 292/230
2,284,436 A * 5/1942 Lundgren ..... E05D 13/1246 49/431
3,634,962 A * 1/1972 Peterson ..... E06B 7/24 49/470
4,790,107 A 12/1988 Cunningham et al.
5,742,978 A * 4/1998 Vetter ..... E05F 7/005 292/DIG. 55
6,401,396 B1 * 6/2002 Koban ..... E05F 5/00 49/404
7,533,497 B2 * 5/2009 Cloutier ..... E06B 3/44 49/176
7,975,432 B2 7/2011 Morton et al.
8,141,299 B2 * 3/2012 Vetter ..... E05F 7/005 16/86 B
9,428,046 B2 * 8/2016 Morris ..... E05F 7/04
10,851,580 B2 * 12/2020 Mastrogiannis .... B29C 53/8041
11,365,582 B1 * 6/2022 Salvoni ..... E06B 1/52
2005/0093342 A1 * 5/2005 Kim ..... E05F 7/005 296/207
2008/0000164 A1 * 1/2008 Erickson ..... E06B 5/113 49/394
2011/0154741 A1 * 6/2011 Pellegrini ..... E05B 85/22 49/501
2013/0160239 A1 * 6/2013 Weron ..... E05F 7/005 29/525.01
2016/0138314 A1 * 5/2016 Kreyenborg ..... E05D 15/0647 49/420
2020/0240202 A1 * 7/2020 Mangat ..... E06B 3/4609
2022/0042368 A1 * 2/2022 Wang ..... E06B 3/06

* cited by examiner

*Primary Examiner* — Victor D Batson
*Assistant Examiner* — Matthew J Sullivan
(74) *Attorney, Agent, or Firm* — RATHE LINDENBAUM LLP

(57) ABSTRACT

A snubber includes an engagement portion with a free end configured to be removably engaged within a groove in a frame. The engagement portion includes a first engagement member and a second engagement member at least partially separated from the first engagement member. The second engagement member deflecting less than the first engagement member when a negative pressure is applied to the sash.

20 Claims, 5 Drawing Sheets

DUAL FUNCTION SNUBBER

BACKGROUND

Casement windows are well known in the art and include a sash connected to a frame typically with a hinge that connects a bottom rail of the sash to bottom portion of the frame such as the sill. A first side of the sash extends further outward from the structure in the fully open position than the opposing side. A lock is used to operatively secure the sash proximate the first side of the sash to a first vertical jamb.

Windows on the downwind side of a structure are subjected to negative pressure—that is, the pressure outside the structure is less than the pressure inside the structure, tending to draw the second non-locked side of the sash away from the frame against which it is sealed. During certain atmospheric events negative windows are also subjected to negative pressure.

Snubbers have been used to assist in opposing retaining the second non-locked side of the sash against the seal between the sash and the frame when the sash is exposed to negative pressure.

SUMMARY

An apparatus includes a snubber having an engagement portion with a free end configured to be removably engaged within a groove in a frame. The engagement portion includes a first engagement member and a second member at least partially separated from the first engagement member. The second member deflecting less than the first engagement member when a negative pressure is applied to the sash.

In one embodiment a fenestration assembly includes a frame having a first jamb and a second jamb and a sash having a first stile and a second stile spaced from and parallel to the first stile. A snubber is operatively connected to the second stile. The snubber includes an engagement portion having a free end configured to be removably positioned within a cavity in the second jamb. The engagement portion includes a first engagement member and a second member, the second member deflects less than the first engagement member when a negative pressure is applied to the sash.

In one embodiment a method of securing a casement window includes providing a casement window having a first stile and a second stile spaced from and parallel to the first stile within a frame having a first jamb and a second jamb spaced from and parallel to the first jamb. A snubber is connected to the second stile, the snubber including an engagement portion having a free end configured to be removably positioned within a cavity in the second jamb. Further including removably engaging the engagement portion having a first engagement member and a second member into a cavity in the second jamb wherein the second member deflecting less than the first engagement member when a negative pressure is applied to the sash.

DETAILED DESCRIPTION OF THE EXAMPLE EMBODIMENTS

Figure 1:
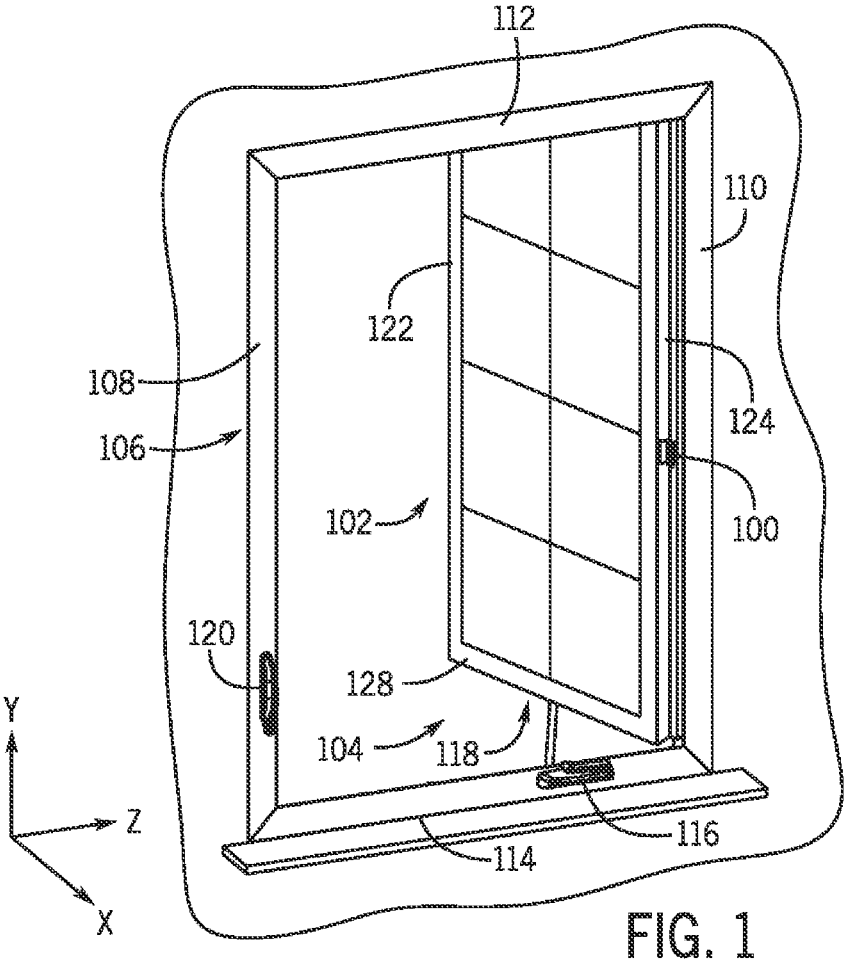
FIG. 1 is an isometric view of a fenestration and snubber.
Figure 1C:
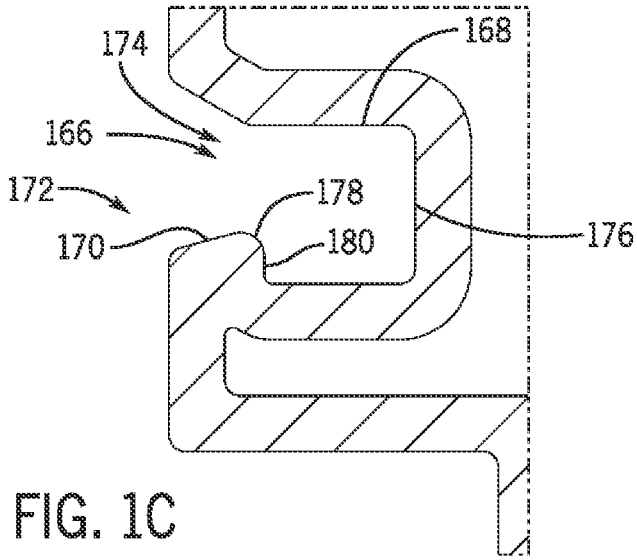
FIG. 1C is a close-up of the snubber engagement portion within a jamb cavity.
Figure 1A:
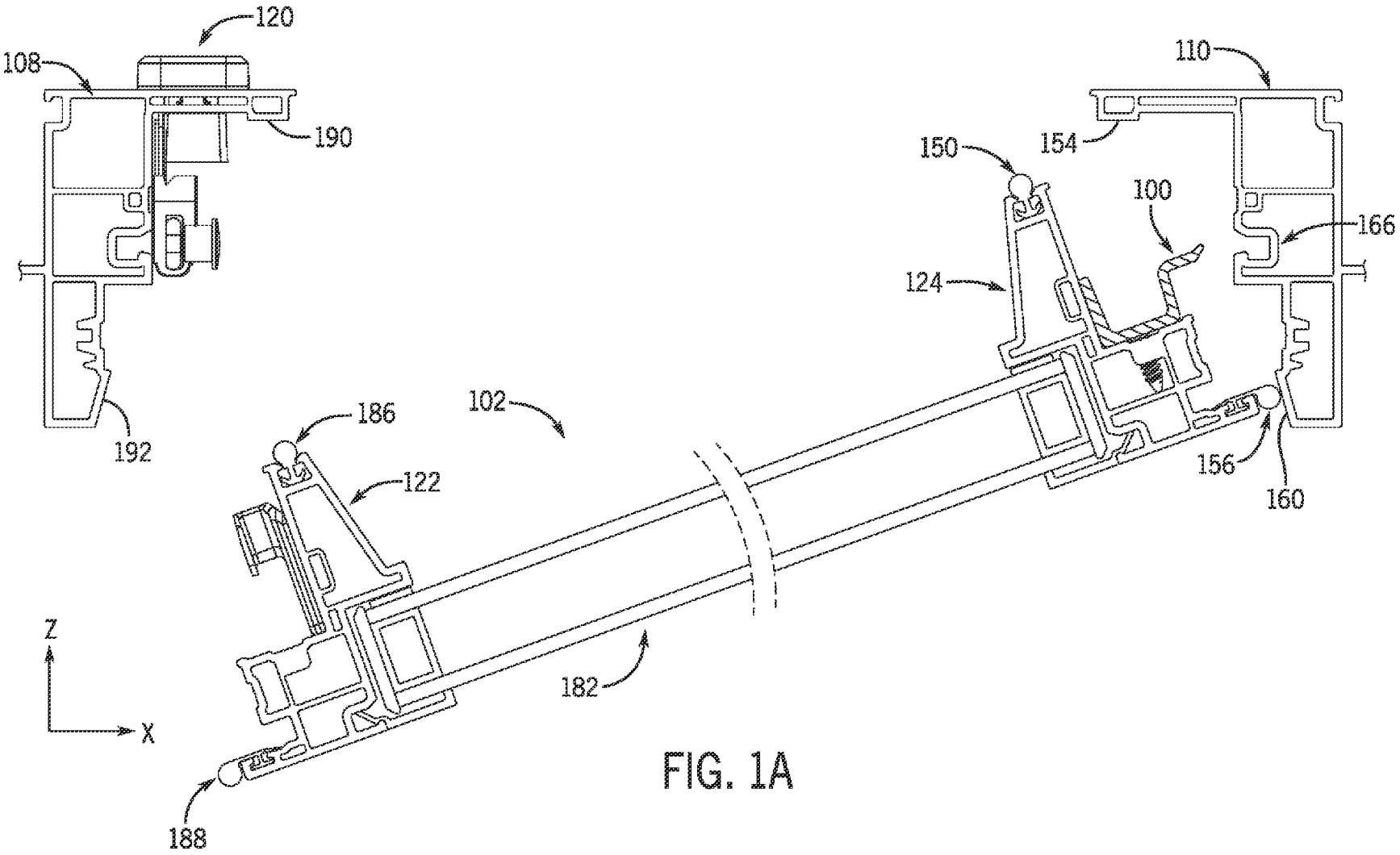
FIG. 1A is a cross-sectional of view of FIG. 1 with the fenestration in an open position.

Referring to FIG. 1 and FIG. 1A, a snubber 100 is attached to a sash 102 of a casement window 104. Casement window 104 includes a hinge that attaches sash 102 to a frame 106. In one embodiment, frame 106 includes a first jamb 108 a spaced second jamb 110 extending substantially parallel to first jamb 108. Frame 106 further includes a header 112 and an opposing spaced sill 114 substantially parallel to header 112. An operator 116 is operatively connected to a hinge 118 to move sash 102 between a fully closed and a fully opened position. A lock 120 operatively secures sash 102 to first jamb 108.

As used herein the term "up" or "upper" is used to reference a general vector direction away from the force of gravity when the window is in an in-use position on a wall of the structure. The term "outward" refers to the direction away from the inside of the structure supporting the window or fenestration toward an exterior of the structure such as a building. The term "inward" refers to the direction toward the interior or inside of the structure. Casement window 104 moves in an outwardly position as the sash is moved or swings from a fully closed to a fully open position.

of a building structure. Referring to FIG. 1 the positive z-axis is in an inward direction, the positive y-axis is in an up direction, and the positive x-axis is in direction perpendicular from the first jamb toward the second jamb the when the casement window and snubber are installed in a structure.

Sash 102 includes a first stile 122 and a second stile 124 spaced from and substantially parallel to first stile 122. Sash 102 further includes a first or top rail (not shown) and a bottom or second rail 128 spaced from and parallel to top rail. A glazing such as glass or plastic is provided between the first stile 122, second stile 124, top rail and second or bottom rail 128.

Figure 1B:
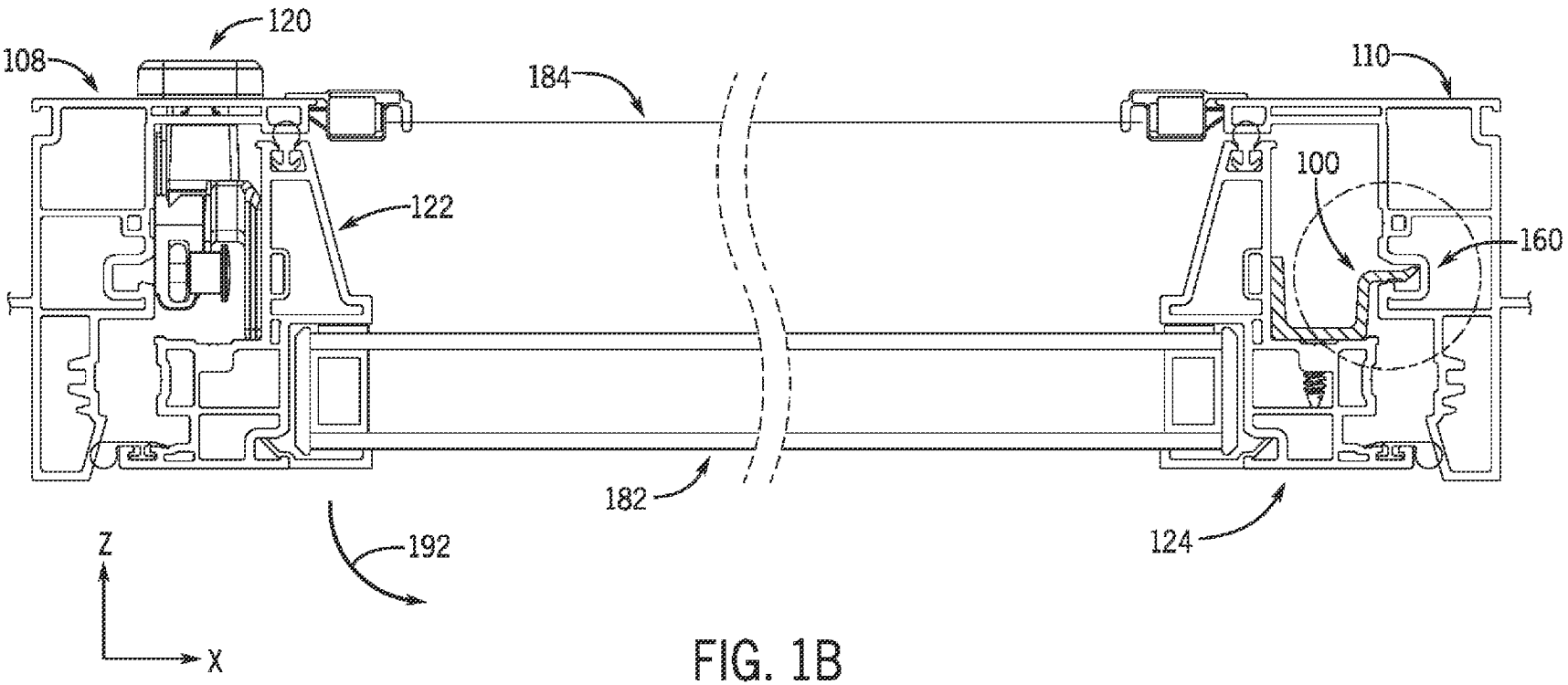
FIG. 1B is a cross-sectional of view of FIG. 1 with the fenestration in a closed position.

Referring to FIG. 1B when casement window is in a fully closed position, first stile 122 is closely adjacent first jamb 108 of frame 106 and second stile 124 is closely adjacent second jamb 110. Stated another way the distance between first stile 122 and first jamb 108 when the casement window is fully closed is less than the distance between second stile 124 and second jamb 110. First jamb 108 is also referred to as the lock jamb since in one embodiment a lock 120 secures sash 102 to first jamb 108. Second jamb 110 is also referred to as the hinge jamb since in one embodiment sash 102 is attached to frame 106 with hinge 118 proximate second jamb 220 and second stile 124. When sash 102 is part of a casement window hinge 118 is connected to bottom rail 128 of sash 102 and sill 114 of frame 106. Casement window hinges and their operation are well known in the art. A second hinge may also be connected to top rail of the sash 102 and header 112 of frame 106. Since in one embodiment there are no physical connections between the second stile of sash 102 and the second jamb 220 of frame 106 sash 102 is subject to bowing upon the application of sufficient negative pressure. The application of negative pressure acts to put the sash in a stressed condition. When the atmospheric pressure inside and outside of the fenestration is the same there is no application of negative pressure and the sash is in a non-stressed condition. The first stile of sash 102 is operatively locked to first jamb 108 with lock 120 that acts to resist bowing upon the application of sufficient negative pressure. Snubber 100 acts to resist bowing of sash 102 proximate second jamb 220 as described herein.

Figure 2:
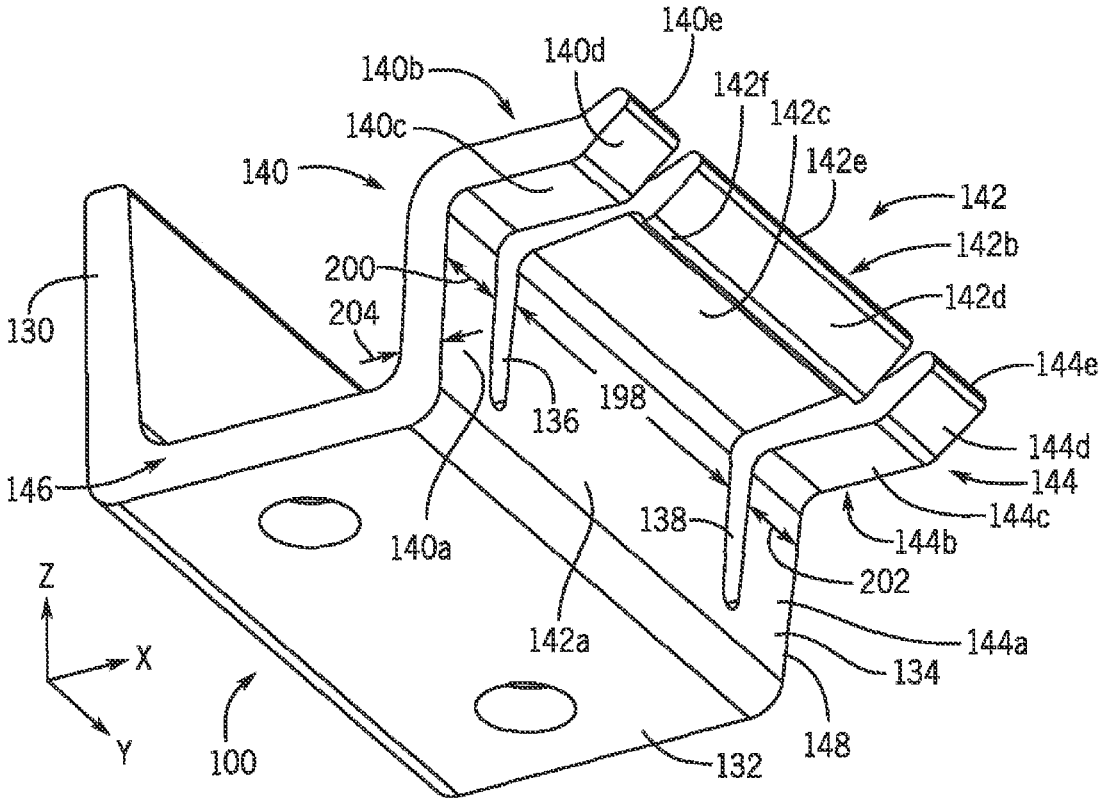
FIG. 2 is an isometric view of a snubber.

Referring to FIG. 2 snubber 100 includes a U shaped portion having a first leg 130, a connection portion 132 extending substantially perpendicular to first leg 130 and a second leg 134 spaced from and substantially perpendicular to connection portion 132. Second leg 134 includes a first slot 136 and a second slot 138 defining a base portion of a first engagement member 140, a second engagement member 142 and a third engagement member 144. Slot 136 and slot 138 at least partially separate first, second and third engagement members 140, 142 and 144. The second engagement member 142 being intermediate first engagement member 140 and third engagement member 144. In one embodiment snubber 100 includes only a first engagement member 140 and a second engagement member 142. In one embodiment snubber 100 includes more than two engagement members. It is contemplated that in one embodiment snubber 100 includes two or more engagement members having similar geometry to second engagement member 142 and one or more engagement members having similar to geometry to first engagement member 140. In one embodiment the geometry of second engagement member 142 is different than the geometry of first engagement member 140 and third engagement member 144. In one embodiment the cross-section of second engagement member 142 is different than the cross-sections of first engagement member 140 and third engagement member 144. Referring to FIG. 2 first engagement member 140 and second engagement member 142 of snubber 100 are a single component.

Figure 5:
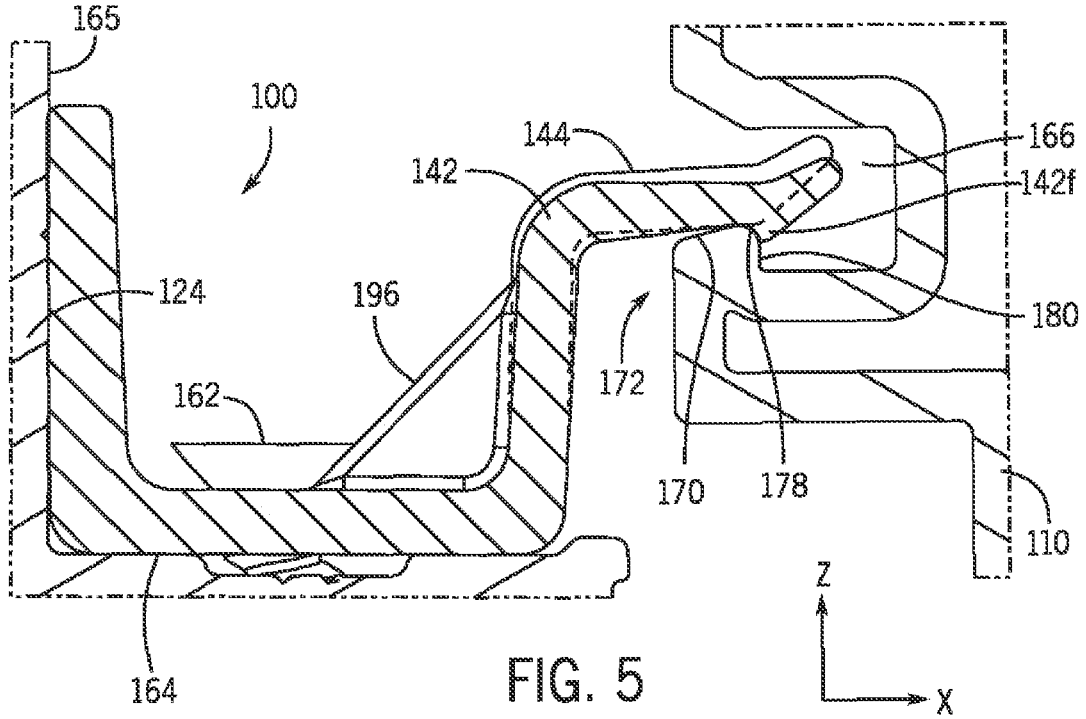
FIG. 5 is cross-sectional view of the snubber in an engaged position and stressed condition showing the flexible and non-flexible portions of the snubber.

Referring to FIG. 5 in one embodiment when sash 102 is in the full closed position and a negative pressure is applied to the sash such that the sash is in a stressed condition second engagement member 142 deflects less than first engagement member 140. In one embodiment the direction of deflection is in the −Z axis direction. In one embodiment second engagement member is rigid.

Each engagement member 140, 142 and 144 includes a first portion 140*a*, 142*a*, 144*a* defined by regions on the second leg 134 and slots 136 and 138. First portion 140*a* of first engagement member 140 extends between slot 136 and a first free end 146 of snubber 100. First portion 142*a* of second engagement member 142 extends intermediate first slot 136 and second slot 138. First portion 144*a* of third engagement member 142 extends intermediate second slot 138 and second free end 148 of snubber 100. Each engagement member includes a second portion 140*b*, 142*b*, 144*b* extending substantially perpendicular to first portion 140*a*, 142*a*, 144*a* respectively. In another embodiment second portions 140*b*, 142*b*, 144*b* may extend from respective first portions 140*a*, 142*a*, 144*a* at other non-zero angles or non-zero radius of curvature as well. Second portions 140*b*, 142*b*, 144*b* include an engagement surface 140*c*, 142*c*, 144*c* and a beveled region 140*d*, 142*d*, 144*d* proximate a distal free end 140*e*, 142*e*, 144*e* of each respective engagement member 140, 142 and 144. In one embodiment a gusset 196 extends between first portion 142*a* and connection portion 132. Note that in one embodiment gusset 196 does not connect first and third engagement members 140 and 144 with connection portion 132. Additionally, the width of first second engagement member 142 as defined as the distance between the first slot 136 and the second slot 138 in a direction perpendicular to a longitudinal axis of first slot 136 and second slot 138 in a plane defined by second leg 134.

Second engagement member 142 defines a hook portion 142*f* extending from engagement surface 142*c* in a general direction away from an upper surface second portion 142 *b*. Hook portion 142*f* as described herein contacts catch portion 172 also referred to as a tab or tab portion.

Figure 3:
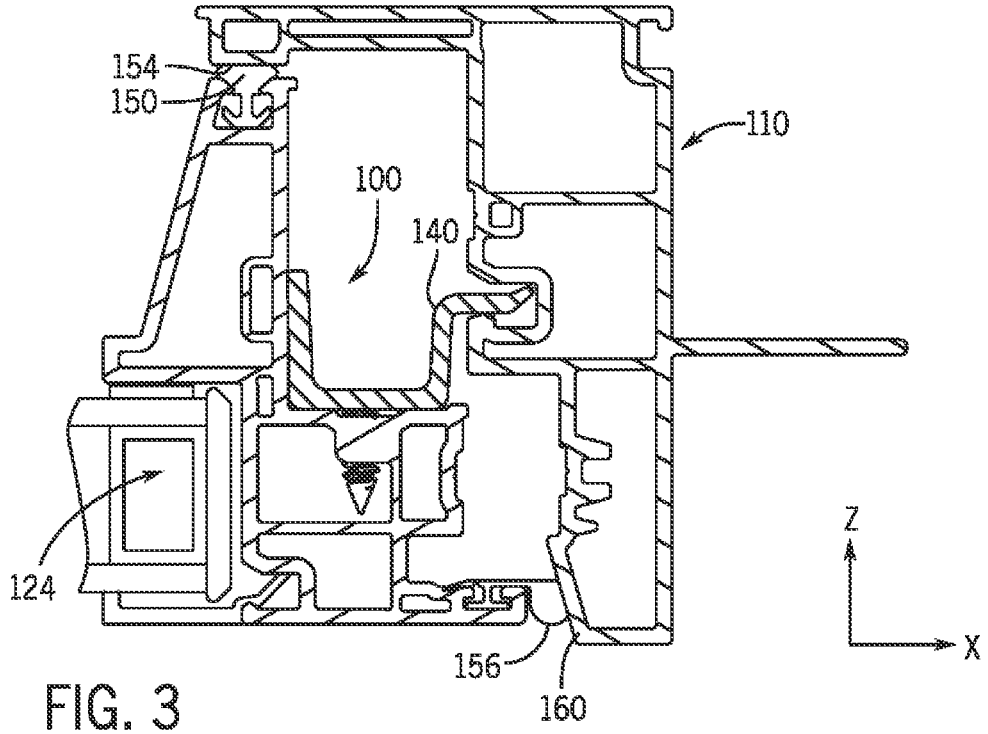
FIG. 3 is a cross-sectional view of the snubber in an engaged position taken about line 3-3 of FIG. 2 showing the flexible portion of the snubber.

Referring to FIG. 3 second stile 124 of sash 102 includes a first weatherstripping 150 operatively sealing an inner portion 152 of second stile 124 against a sealing surface 154 of second jamb 110. In one embodiment second stile 124 also includes a second weatherstripping 156 operatively sealing a second portion 158 of second stile against a second sealing surface 160 on second jamb 110.

Snubber 100 is connected to second stile with one or more fasteners 162 securing connection portion 132 to a portion 164 of second stile 124. In one embodiment fastener 162 is a screw, however fasteners known in the art may also be used. Sash 102 is moved from a fully open position to a fully closed position via hinge 118 moved by the operator 116 as is known in the art. The free ends of engagement members 140, 142, 144 are received within a groove 166 within second jamb 110.

Referring to FIG. 1C groove 166 is defined by a generally U shaped wall 168 having an optional beveled portion 170 on the outward portion of the generally U shape wall extending inwardly to catch portion 172 portion having an apex or catch engagement portion 178. A catch extension portion 180 extends from apex portion 178 in a generally outwardly direction that engages hook portion 142*f* when the sash is in the fully closed position and in a stressed position under negative pressure. However, groove 166 may be a cavity having other geometries that provide a recess into which portions of the engagement members can be removably received.

In a fully open position the free ends 140*e*, 142*e*, 144*e* of the first, second and third engagement members 140, 142, 144 are not located within groove 166. Stated another way in the fully open position of the sash a groove opening 174 is intermediate a base 176 of the U shaped wall and the free ends 140*e*, 142*e* and 144*e* of the respective first, second and third engagement members 140, 142 and 144.

The movement of sash 102 by hinge 118 allow the free ends 140*e*, 142*e*, 144*e* of respective first, second and third engagement members 140, 142, 144 to enter groove 166 through opening 174 without contacting any portion of the U shaped wall 168. However, in the fully closed position and in the non-stressed condition engagement surfaces 140*c* and 144*c* of the first and third engagement members 140, 144 contact the catch engagement surface 178 but in the fully closed and non-stressed condition the engagement surface 142*c* does not contact the catch engagement surface 178.

Figure 4:
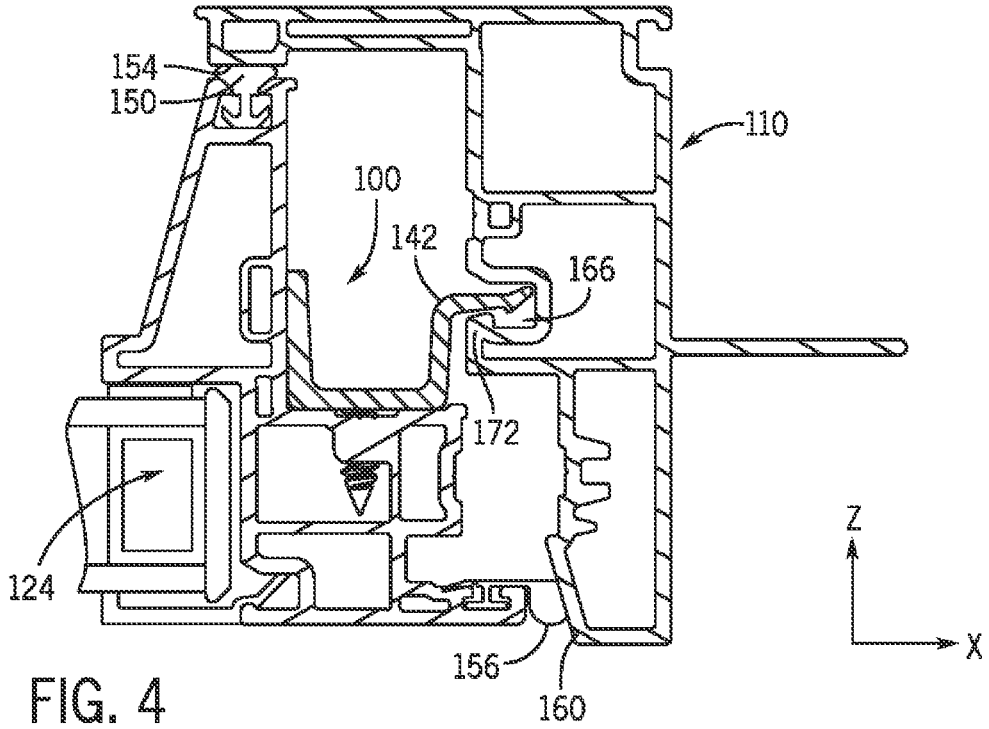
FIG. 4 is a cross-sectional view of the snubber in an engaged position taken about line 4-4 of FIG. 2 showing the non-flexible portion of the snubber.

Referring to FIG. 3 and FIG. 4 in one embodiment when sash 102 is in the fully closed position engagement surfaces 140*c* and 144*c* contact catch engagement surface 178 of catch 172, however engagement surface 142*c* does not contact inwardly catch engagement surface 178 of catch 172. First and second engagement members 140, 144 deflect as sash 102 is moved to the fully closed position to provide a biasing force against movement of sash 102 in an outwardly direction.

Referring to FIG. 5, upon the application of sufficient negative pressure to sash 102, engagement members 140 144 continue to deflect as sash 102 moves in an outwardly direction as a reaction to the negative atmospheric pressure. Once sash 102 moves outwardly a predetermined distance engagement surface 142*c* of second engagement member contacts catch engagement surface 178 of catch portion 172 and hook portion 142*f* contacts the catch extension portion 180 of catch 172. Since second engagement member deflects less than the first and third engagement members, second engagement member acts to resist the force acting on the sash by the negative pressure to bow the sash. In this manner second engagement member 142 prevents movement of the sash away from the frame upon an application of negative pressure to the sash. When sufficient negative pressure is applied to sash 102 second stile tends to move in both an outwardly and in a cross frame direction that is perpendicular to second jamb toward first jamb. Engagement of hook portion 142*f* of snubber 100 with catch extension portion 180 acts to resist outwardly movement as well as movement in the cross frame direction. Hook portion 142*f* is also referred to as hook 142*f*.

As noted above second stile 126 is sealed against second jamb with a first weatherstripping 150 and a second weatherstripping 156. As sash 102 is moved to the full closed first engagement member 140 contacts catch engagement surface 178 that operatively acts to bias weatherstripping 150 toward surface 154 of jamb 110. In this manner snubber aids in creating a tight seal between stile 124 and jamb 110. The interference fit between engagement surfaces 140*c* and 144*c* with tab 172 when the sash is in the fully closed position acts to bias sash 102 toward jamb surface 154 so that weatherstripping 150 provides a tight seal between sash 102 and frame 106. This sealing function along with the function of the hook 142*f* and catch surface extension portion 180 provides the dual function of snubber 100. Stated another way snubber 100 includes a first engagement member 140 that biases the hinge stile 124 of sash 102 in an inwardly direction against jamb 110 to ensure a tight seal between weatherstripping 150 of sash 102 and the frame 106. The direction that engagement member 140 biases the sash toward the frame includes a vector direction generally opposite to the direction that sash 102 opens. In one embodiment first stile of sash 102 opens in an outwardly direction and snubber 100 biases the second stile of sash 102 in an inwardly direction when the sash 102 is in the fully closed position. In one embodiment the second engagement member 142 does not bias the sash 102 in an inwardly direction and only resists movement of the second stile 126 when sash 102 is subject to a negative pressure.

In embodiment a method of securing a casement window 104 includes providing a casement window 104 having a first stile 122 and a second stile 124 spaced from and parallel to the first stile 122 within a frame 106 having a first jamb 108 and a second jamb 110 spaced from and parallel to the first jamb 108. Further the method includes connecting a snubber 100 to the second stile 124, the snubber 100 including an engagement portion having a free end configured to be removably positioned within a cavity 166 in the second jamb 110. Additionally, the method includes removably engaging the engagement portion having a first engagement member 140 and a second member 142 into the cavity 166 in the second jamb 110 wherein the second engagement member 142 deflects less than the first engagement member 140 when a negative pressure is applied to the sash 102. In another aspect the method includes the first engagement member 140 contacting a portion of the second jamb 110 when the sash 102 is in a closed position and a region proximate a free end of the second member 142 contacts a tab 172 in second jamb 110 only when the sash 102 is in the closed position and in a stressed condition.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described is manifestly intended to be as broad as possible. For example, unless specifically otherwise noted, the definitions reciting a single particular element also encompass a plurality of such particular elements.

What is claimed is:

1. An apparatus comprising:

a snubber having a first portion configured to be operatively connected to a fenestration assembly including a sash and a frame;

the snubber including an engagement portion having a free end configured to be removably engaged within a groove in the fenestration assembly; and the engagement portion including a first engagement member and a second engagement member at least partially separated from the first engagement member, the second engagement member deflecting less than the first engagement member when a negative pressure is applied to the sash, wherein the first portion, the first engagement portion and the second engagement portion are a single component.

2. The apparatus of claim 1, wherein the second engagement member has a hook contacting a tab portion of the groove preventing movement of the sash away from the frame upon an application of negative pressure to the sash.

3. The apparatus of claim 1, wherein a free end of the first engagement member has cross-section that is different than a cross-section of a free end of the second engagement member.

4. The apparatus of claim 1, wherein a portion of the first engagement member contacts a tab portion on the frame when the sash is in a closed position.

5. The apparatus of claim 4, wherein the first engagement member bias the sash toward the frame in an inwardly direction when the sash is in a fully closed position.

6. The apparatus of claim 1, wherein a free end of the second engagement member does not contact a tab portion of the frame when the sash is in a closed position and in a non-stressed condition.

7. The apparatus of claim 1, wherein a hook portion of the free end of the second engagement member contacts a tab portion of the frame only when the sash is in a closed position and subject to a stressed condition.

8. The apparatus of claim 1, wherein a gusset connects only the second engagement member to the first portion of the snubber.

9. The apparatus of claim 1, further including a third engagement member spaced from the second engagement member, wherein the second engagement member is intermediate the first engagement member and the third engagement member.

10. The apparatus of claim 1 wherein the second engagement member has a width greater than a width of the second engagement member.

11. The apparatus of claim 1 wherein the engagement portion does not prevent movement of the sash in a direction extending perpendicular between a second jamb and a first jamb of the frame when the sash is in a closed position and in a non-stressed condition.

12. The apparatus of claim 1, wherein the sash is part of a casement window that opens by swinging in one of an outwardly direction away from an interior of a building toward an exterior of the building and an inwardly direction away from an exterior of a building toward an interior of a building.

13. The apparatus of claim 1, wherein the sash defines a door panel.

14. A fenestration assembly comprising:

a frame having a first jamb and a second jamb;

a sash having a first stile and a second stile spaced from and parallel to the first stile;

a snubber operatively connected to the second stile, the snubber including an engagement portion having a free end configured to be removably positioned within a cavity in the second jamb; and the engagement portion including a first engagement member and a second engagement member, the second engagement member deflecting less than the first engagement member when a negative pressure is applied to the sash, wherein the first portion, the first engagement portion and the second engagement portion are a single component.

15. The fenestration assembly of claim 14 wherein the first engagement member contacts a portion of the second jamb when the sash is in a closed position biasing the sash toward the second jamb in an inwardly direction and a free end of the second engagement member contacts a tab portion on the frame only when the sash is in the closed position and in a stressed condition.

16. The fenestration assembly of claim 15, wherein a hook portion of the free end of the second engagement member contacts a tab portion of the frame only when the sash is in a closed position and subject to a stressed condition.

17. The fenestration assembly of claim 14, further including a third engagement member spaced from the second engagement member, wherein the second engagement member is intermediate the first engagement member and the third engagement member.

18. The fenestration assembly of claim 14, wherein the engagement portion does not prevent movement of the sash in a direction extending perpendicular from the second jamb toward the first jamb when the sash is in a closed position and in a non-stressed condition and wherein the sash is part of a casement window that swings in an outwardly direction away from an interior of a building toward an exterior of the building.

19. A method of securing a casement window comprising:

providing a casement window having a sash with a first stile and a second stile spaced from and parallel to the first stile within a frame having a first jamb and a second jamb spaced from and parallel to the first jamb;

connecting a snubber to the second stile, the snubber including an engagement portion having a free end configured to be removably positioned within a cavity in the second jamb; and removably engaging the engagement portion having a first engagement member and a second engagement member into a cavity in the second jamb wherein the second engagement member deflecting less than the first engagement member when a negative pressure is applied to the sash, wherein the first portion, the first engagement portion and the second engagement portion are a single component.

20. The method of claim 19, wherein the first engagement member contacts and biases the second stile toward the second jamb in an inwardly direction to seal the sash to the second jamb when the sash is in a closed position and a hook portion of the second engagement member contacts a tab portion of the second jamb only when the sash is in a closed position and in a stressed condition.

* * * * *